US005139272A

United States Patent [19]

Villafuerte

[11] Patent Number: 5,139,272

[45] Date of Patent: Aug. 18, 1992

[54] TARGET GAME APPARATUS

[76] Inventor: Armando P. Villafuerte, 1353 Walker Dr., Soledad, Calif. 93960

[21] Appl. No.: 756,513

[22] Filed: Sep. 9, 1991

[51] Int. Cl.[5] ..... F41J 9/00; A63B 67/06

[52] U.S. Cl. ..... 273/345; 273/368; 273/409

[58] Field of Search ..... 273/368, 345, 346, 409

[56] References Cited

U.S. PATENT DOCUMENTS

| | | | |
|---|---|---|---|
| 2,056,095 | 9/1936 | Cookson | 273/368 |
| 2,179,471 | 11/1939 | Lee | 273/368 |
| 3,147,976 | 9/1964 | Millar | 273/345 |
| 4,305,587 | 12/1981 | O'Grady | 273/345 |
| 4,736,955 | 4/1988 | Pollock | 273/346 X |

FOREIGN PATENT DOCUMENTS

| | | | |
|---|---|---|---|
| 248592 | 3/1926 | United Kingdom | 273/368 |
| 2224665 | 5/1990 | United Kingdom | 273/345 |

OTHER PUBLICATIONS

Playthings, Feb. 1976, STS Industries Safe Dart Games No. 100.

*Primary Examiner*—Paul E. Shapiro
*Attorney, Agent, or Firm*—Leon Gilden

[57] ABSTRACT

A target game includes a rotating cylindrical housing, including a top surface with an interior cavity, with the top surface of the cylindrical housing demarcated into a multiplicity of segments to include a central area, medial segments, and outer segments, with each of the segments and central area demarcated into various scoring zones. A bottom surface of the top wall of the cylindrical housing includes magnetic strips mounted medially and radially relative to the outer segments, with a plurality of parallel magnetic strips positioned within the central and medial segments to accommodate ferrometallic discs directed onto the top wall to utilize rotational spinning of the housing in conjunction with magnetic forces to effect arbitrary point totals as the discs are projected into various of the segments.

2 Claims, 4 Drawing Sheets

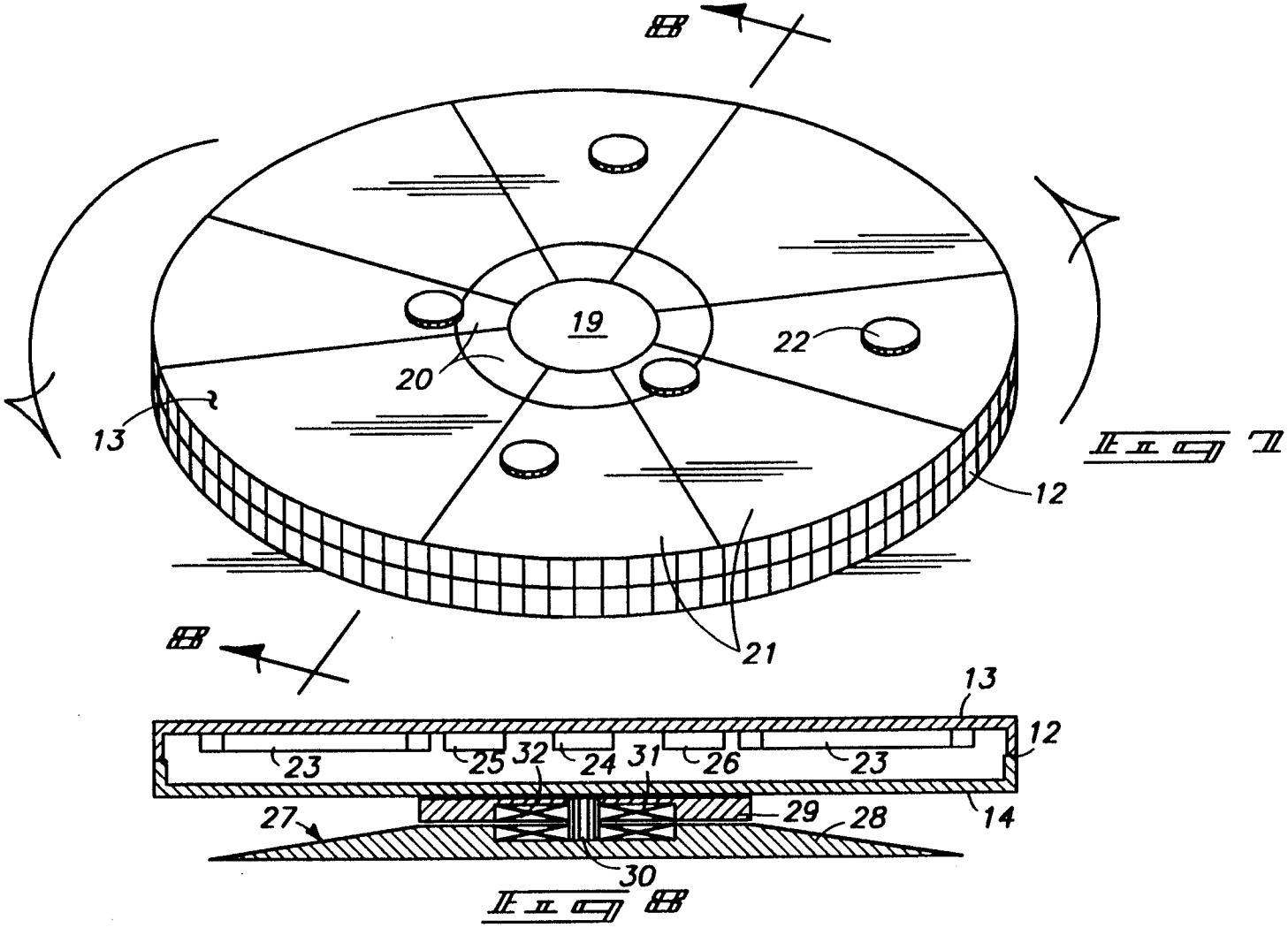
12
13
14
19
20
21
22
23
24
25
26
27
28
29
30
31
32

TARGET GAME APPARATUS

BACKGROUND OF THE INVENTION

1. Field of the Invention

The field of invention relates to toss game apparatus, and more particularly pertains to a new and improved target game apparatus wherein the same is arranged to accommodate ferrometallic discs projected upon a top surface of a rotating cylindrical housing 2. Description of the Prior Art Various toss games of different constructions are utilized in the prior art to provide entertainment and amusement to individuals. Such apparatus is exemplified in U.S. Pat. No. 3,892,407 to Higgins wherein magnetically attractable apertured washers are tossed about an associated peg, with an embodiment utilizing a magnet extending under a single portion of the game board.

U.S. Pat. No. 4,736,955 to Pollock sets forth a toss game wherein fibrous engaging materials are utilized to engage discs tossed at the game board.

U.S. Pat. No. 3,815,915 to Chapman sets forth a ring and disc toss structure directed to relative recesses and pegs of a game board.

U.S. Pat. No. 4,261,578 to Grottola sets forth an arcuately curved target with various pins mounted within a concave surface of the target to receive rings tossed at the associated pins.

As such, it may be appreciated that there continues to be a need for a new and improved target game apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of game apparatus now present in the prior art, the present invention provides a target game apparatus wherein the same is arranged to receive and adhere magnetically attractable discs directed at a top surface of a rotating cylindrical housing to effect various scores as the discs are adhered to various positions of the housing top wall. As such, the general purpose of the present invention, which will be described subsequently in greater detail, is to provide a new and improved target game apparatus which has all the advantages of the prior art game apparatus and none of the disadvantages.

To attain this, the present invention provides a target game including a rotating cylindrical housing, including a top surface with an interior cavity, with the top surface of the cylindrical housing demarcated into a multiplicity of segments to include a central area, medial segments, and outer segments, with each of the segments and central area demarcated into various scoring zones. A bottom surface of the top wall of the cylindrical housing includes magnetic strips mounted medially and radially relative to the outer segments, with a plurality of parallel magnetic strips positioned within the central and medial segments to accommodate ferrometallic discs directed onto the top wall to utilize rotational spinning of the housing in conjunction with magnetic forces to effect arbitrary point totals as the discs are projected into various of the segments.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved target game apparatus which has all the advantages of the prior art game apparatus and none of the disadvantages.

It is another object of the present invention to provide a new and improved target game apparatus which may be easily and efficiently manufactured and marketed.

It is a further object of the present invention to provide a new and improved target game apparatus which is of a durable and reliable construction.

An even further object of the present invention is to provide a new and improved target game apparatus which is susceptible of a low cost of manufacture with regard to both materials and labor, and which accordingly is then susceptible of low prices of sale to the consuming public, thereby making such target game apparatus economically available to the buying public.

Still yet another object of the present invention is to provide a new and improved target game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an isometric illustration of the invention arranged for rotation.

FIG. 8 is an orthographic view, taken along the lines 8—8 of FIG. 7 in the direction indicated by the arrows.

DESCRIPTION OF THE PREFERRED EMBODIMENT

Figure 1:
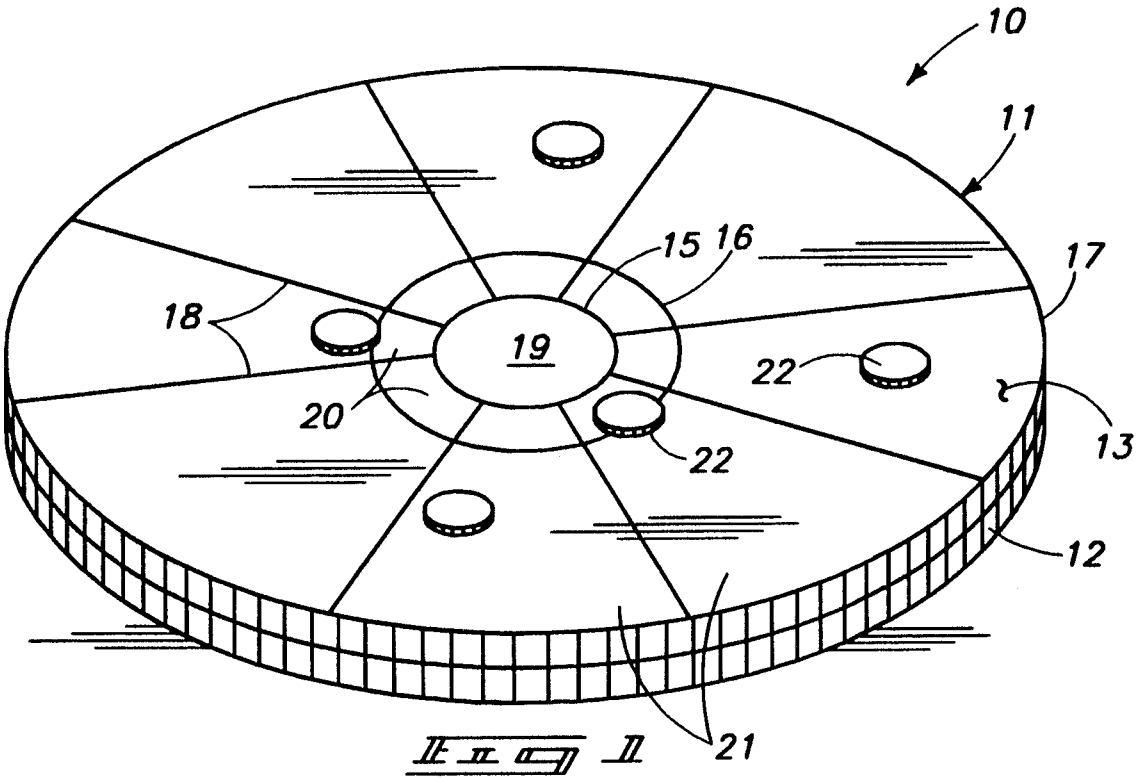
FIG. 1 is an isometric illustration of the instant invention.
Figure 2:
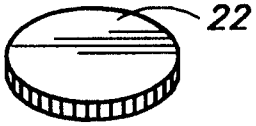
FIG. 2 is an isometric illustration of a tossing disc utilized by the invention.

With reference now to the drawings, and in particular to FIGS. 1 to 8 thereof, a new and improved target game apparatus embodying the principles and concepts of the present invention and generally designated by the reference numeral 10 will be described.

Figure 3:
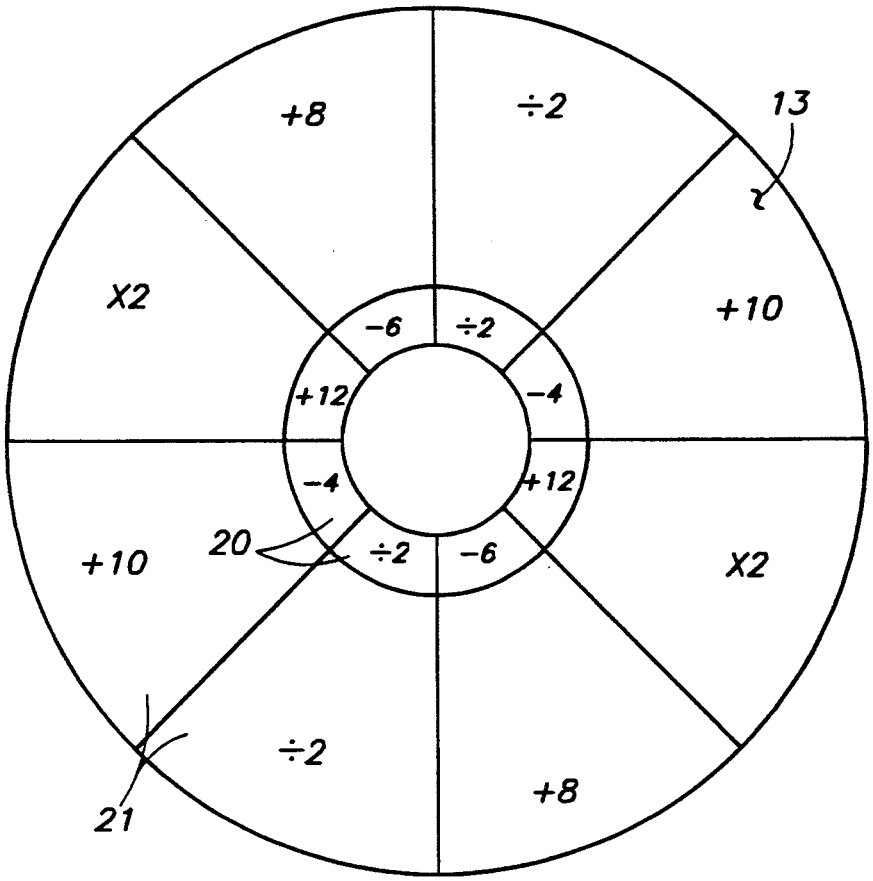
FIG. 3 is an orthographic top view of the instant invention.
Figure 4:
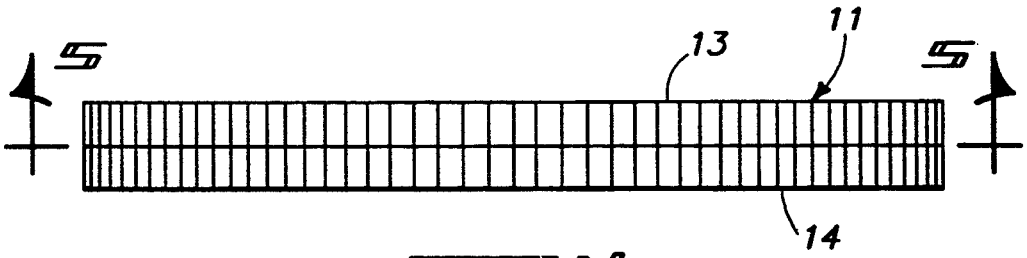
FIG. 4 is an orthographic side view of the instant invention.

More specifically, the target game apparatus 10 of the instant invention essentially comprises a cylindrical housing 11 defined by a cylindrical side wall, with a planar top wall 13 spaced from and parallel a planar bottom wall 14. The top wall 13 includes a top surface demarcated by a first inner circle 15, a second medial circle 16, and the housing outer perimeter circle 17. Equally spaced radial lines 18 directed from and between the inner circle 15 to the outer perimeter 17 divides the top wall top surface into a central circular area 19, medial segments 21 between the first circle 15 and the second circle 16, and outer segments 21 between the medial circle 16 and the outer perimeter 17. Ferrometallic discs 22 of a predetermined quantity are provided each player, who in turn projects and casts the discs upon the top surface attempting to access various ones of the segments or the central area 19. The central area and the segments are afforded arbitrary point totals, in a manner as illustrated in FIG. 3.

Figure 5:
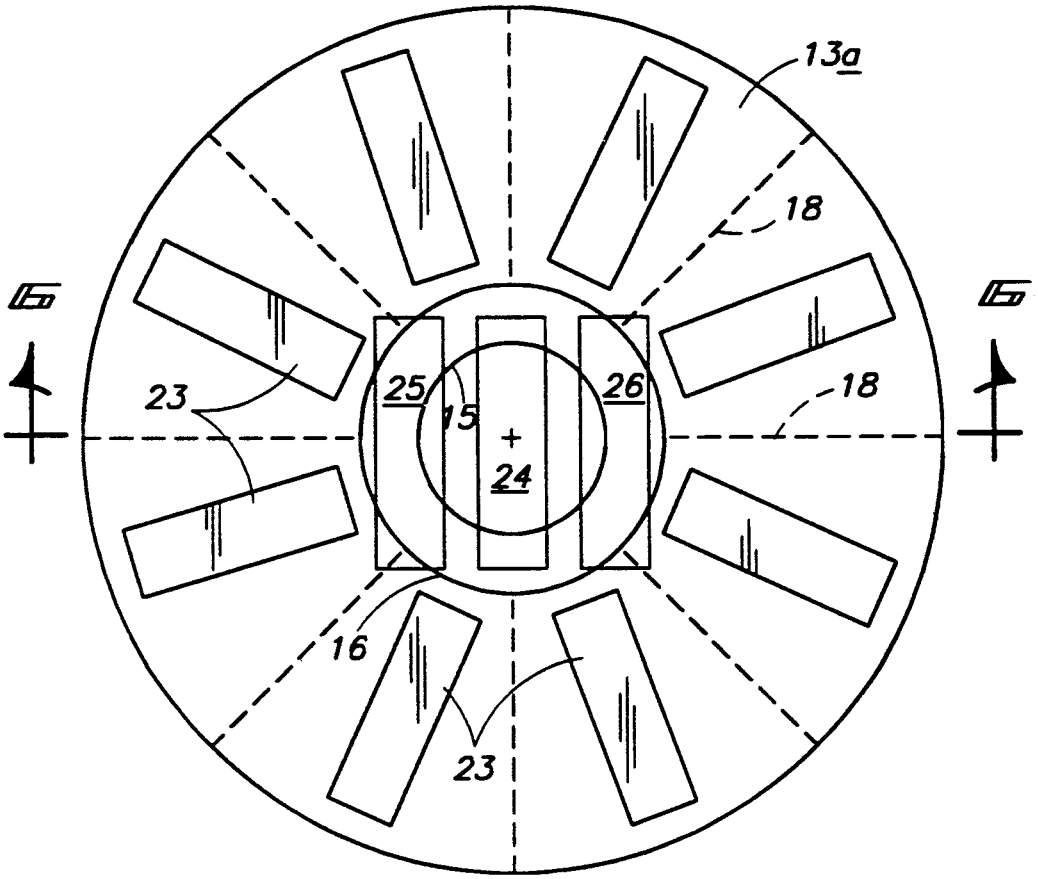
FIG. 5 is an orthographic view, taken along the lines 5—5 of FIG. 4 in the direction indicated by the arrows.
Figure 6:
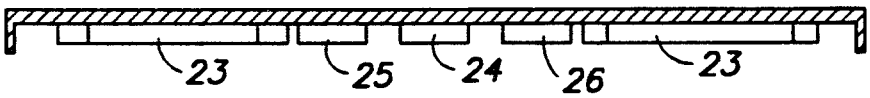
FIG. 6 is an orthographic side view, taken along the lines 6—6 of FIG. 5 in the direction indicated by the arrows.

To add to the entertainment and skill as well as the interest in play of the game, a series of magnetic strips are mounted to the top wall bottom surface 13*a*, in a manner as illustrated in FIG. 5. Specifically, a plurality of radial magnetic strips 23 of a predetermined number equal to the predetermined number of outer segments 21 provide a magnetic strip 23 within each of the segments that are radially aligned medially within each of the segments 21 and wholly contained therewithin between the second circle 16 and the outer perimeter 17. A central magnetic strip 24 is diametrically aligned Within the second medial circle 16, with a respective first and second outer magnetic strip 25 and 26 positioned upon opposed sides in a parallel coextensive relationship relative to the central magnetic strip 24 positioned between the adjacent radial magnetic strips 23. In this manner, the magnetic strips provide adherence to the discs 22. Further, the cylindrical housing 11 is arranged for rotation, in a manner as illustrated in FIG. 8, to thereby impart an enhanced degree of difficulty in projecting one of the discs 22 by the players to a desired one of the segments or central area of the game board defined by the planar top wall top surface.

To rotatably mount the cylindrical housing 11, a base assembly 27 includes a truncated conical lower base 28, with an upper base 29 coaxially and rotatably mounted relative to the floor base 28 by a central axle 23. The upper base 29 is secured to the bottom wall 14 in a coaxial relationship, with the central axle 30 mounted within respective lower and upper bearings 31 and 32 of the lower base 28 and the upper base 29 respectively. In this manner, rotation of the cylindrical housing 11 is effected in play of the game. Specifically, the housing 11 is rotated while each player directs the predetermined number of discs 22 onto the game board in an effort to maximize a point total. After an arbitrary number of turns are awarded each player, the point total is tallied and a player with the greatest point total is declared a winner.

As to the manner of usage and operation of the instant invention, the same should be apparent from the above disclosure, and accordingly, no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A target game apparatus, comprising in combination, a cylindrical housing, the cylindrical housing including a cylindrical side wall, a planar top wall, and a planar bottom wall spaced from and parallel the planar top wall, the planar top wall including a first inner circle spaced from and concentric with a second medial circle, and the second medial circle spaced and positioned between the first inner circle and a housing outer perimeter, and radial lines directed between the first inner circle and the housing outer perimeter, wherein a central area is defined within the first inner circle, medial segments are defined between the radial lines and the inner circle and the medial circle, and outer segments are defined between the medial circle and the outer perimeter, and the inner circle is defined by a first point total, the medial segments are defined by a variety of further point totals, and the outer segments are defined by a yet further variety of point totals, and a predetermined number of ferromagnetic discs are provided for projection upon the planar top wall for positioning within one of the central area, medial segments, and outer segments to derive a point total, and the planar top wall includes a planar top wall bottom surface, the bottom surface includes a plurality of radial magnetic strips, a magnetic strip of each of the radial magnetic strips fixedly secured to the bottom surface radially aligned within each outer segment positioned between the medial circle and the outer perimeter, and a central magnetic strip mounted fixedly to the bottom surface diametrically aligned within the central area, and a first outer magnetic strip and second outer magnetic strip fixedly mounted to the bottom surface on opposed sides of the central magnetic strip, wherein the central magnetic strip, the first outer magnetic strip, and the second outer magnetic strip are arranged in a parallel relationship and are positioned between the radial magnetic strips.

2. An apparatus as set forth in claim 1 wherein the cylindrical housing is rotatably mounted relative to a base assembly, the base assembly includes a truncated conical lower base, with the lower base rotatably mounting an upper base, the upper base coaxially aligned relative to the lower base, and the upper base fixedly secured to the cylindrical housing bottom wall coaxially aligned with the cylindrical housing, and the upper base and lower base include a central axle to rotatably mount the upper base relative to the lower base, and the central axle rotatably mounted within a lower bearing, wherein the lower bearing is contained within the lower base, and the central axle including an upper bearing spaced above the lower bearing and contained within the upper base to rotatably mount the central axle within the lower base and the upper base.

* * * * *